US008936107B2

(12) United States Patent
Numata

(10) Patent No.: US 8,936,107 B2
(45) Date of Patent: Jan. 20, 2015

(54) ROTARY TOOLS

(75) Inventor: Fumitoshi Numata, Anjo (JP)

(73) Assignee: Makita Corporation, Anjo-shi (JP)

( * ) Notice: Subject to any disclaimer, the term of this patent is extended or adjusted under 35 U.S.C. 154(b) by 706 days.

(21) Appl. No.: 13/242,604

(22) Filed: Sep. 23, 2011

(65) Prior Publication Data

US 2012/0080207 A1 Apr. 5, 2012

(30) Foreign Application Priority Data

Oct. 4, 2010 (JP) ..... 2010-224729

(51) Int. Cl.

| | |
|---|---|
| ***B25F 5/00*** | (2006.01) |
| ***B24B 47/28*** | (2006.01) |
| ***B24B 23/02*** | (2006.01) |
| ***B24B 47/12*** | (2006.01) |

(52) U.S. Cl.

CPC ..... *B24B 47/28* (2013.01); *B24B 23/028* (2013.01); *B24B 47/12* (2013.01)

USPC ..... 173/216; 173/104; 173/162.1; 173/210; 173/217; 451/344

(58) Field of Classification Search

USPC ..... 173/213, 216, 217, 210, 211, 162.1, 173/104; 451/342, 344, 352, 354

See application file for complete search history.

(56) References Cited

U.S. PATENT DOCUMENTS

| | | | | |
|---|---|---|---|---|
| 3,667,310 | A * | 6/1972 | Hahner | 74/417 |
| 3,817,115 | A * | 6/1974 | Schnizler et al. | 74/417 |
| 4,735,020 | A * | 4/1988 | Schulz et al. | 451/344 |
| 5,103,561 | A * | 4/1992 | Harada et al. | 30/276 |
| 6,277,013 | B1 * | 8/2001 | Sasaki et al. | 451/360 |
| 6,464,572 | B2 * | 10/2002 | Jansson | 451/344 |
| 6,619,410 | B2 * | 9/2003 | Kamimura et al. | 173/216 |
| 6,712,157 | B2 * | 3/2004 | Hansson | 173/216 |
| 7,357,195 | B2 * | 4/2008 | Kamimura et al. | 173/216 |
| 8,231,438 | B2 * | 7/2012 | Kuhnle et al. | 451/359 |
| 2006/0191365 | A1 | 8/2006 | Stierle et al. | |
| 2009/0068936 | A1 * | 3/2009 | Kuhnle et al. | 451/344 |
| 2010/0018736 | A1 | 1/2010 | Wiker | |

FOREIGN PATENT DOCUMENTS

| | | |
|---|---|---|
| DE | 39 22 552 A1 | 1/1991 |
| DE | 102 59 519 A1 | 7/2004 |
| DE | 10 2006 001 985 A1 | 7/2007 |
| JP | A-9-287404 | 11/1997 |
| JP | A-2002-264031 | 9/2002 |
| JP | A-2002-327831 | 11/2002 |
| JP | A-2007-275999 | 10/2007 |
| JP | A-2010-179436 | 8/2010 |

OTHER PUBLICATIONS

Office Action issued in Japanese Patent Application No. 2010-224729 mailed Feb. 18, 2014 (with translation).

Extended European Search Report issued in European Patent Application No. 11182908.1 on Jun. 28, 2013.

* cited by examiner

*Primary Examiner* — Scott A. Smith

(74) *Attorney, Agent, or Firm* — Oliff PLC

(57) ABSTRACT

A rotary tool includes a drive device, a driven member configured to be rotatably driven by the drive device, a spindle rotatably supported within a housing, an impact attenuation mechanism disposed between the driven member and the spindle and transmitting rotation of the driven member to the spindle while an impact applied to the driven member being attenuated, and a driven member support bearing rotatably supporting the driven member, so that the driven member can rotate relative to the spindle.

14 Claims, 3 Drawing Sheets

ROTARY TOOLS

This application claims priority to Japanese patent application serial number 2010-224729, the contents of which are incorporated herein by reference.

BACKGROUND OF THE INVENTION

1. Field of the Invention

The present invention relates to rotary tools, such as disk grinders.

2. Description of the Related Art

In general, this kind of rotary tools is configured such that rotation of an electric motor disposed within a tool body is transmitted to a spindle via a reduction gear train that reduces the rotation of the electric motor. In the case of disk grinders, the reduction gear train includes a drive-side bevel gear and a driven-side bevel gear meshing with the drive-side bevel gear. The spindle has a circular grinding wheel mounted thereon and is supported so as to be rotatable about an axis that is perpendicular to the output shaft of the electric motor.

Due to a suitable backlash provided in the reduction gear train or due to the other factors, a start shock may be produced at the time when the gears are engaged for transmitting torque as the motor is started. Therefore, in this kind of rotary tools, there have been proposed various techniques for resolving or reducing the start shock.

For example, Japanese Laid-Open Patent Publication Nos. 2002-264031 and 2010-179436 disclose techniques relating to impact attenuation mechanisms for reducing a shock that may be produced as a motor is started. The impact attenuation mechanisms include a radially resiliently deformable C-shaped torque transmission member that is interposed between a driven gear and a spindle in a torque transmission path. As the motor is started, the torque transmission member resiliently deforms in the radial direction, so that a start shock is absorbed while the drive torque is transmitted from the driven-gear to the spindle via the torque transmission member.

However, because the drive torque is necessary to be transmitted via the C-shaped torque transmission member in the above known impact attenuation mechanisms, the driven gear is necessary to be rotatably supported on the spindle. To this end, the spindle is inserted into a support hole (an inner circumferential hole) formed in the driven gear while a suitable clearance is provided between the inner circumferential surface of the support hole and the outer circumferential surface of the spindle. The clearance is set, for example, to be between about 0.004 mm and about 0.050 mm in order to minimize the displacement (offset with respect to the center) between the driven gear and the spindle, while ensuring easy assembling of these elements. Because the driven gear is rotatably supported on the spindle while a small clearance is provided therebetween, it may be possible that the inner circumferential surface of the support hole of the driven gear and the outer circumferential surface of the spindle are worn through contact therebetween. If the wear progresses, the gear and the spindle may be displaced with respect to the center from each other to cause improper meshing of the gears, resulting in generation of vibrations. As a result, the durability of the electric motor may be lowered.

Therefore, there has been a need in the art for a rotary tool that has an impact attenuation mechanism provided between a driven member and a spindle and that can reduce wear of the driven member and the spindle.

SUMMARY OF THE INVENTION

According to the present teaching, a rotary tool includes a drive device, a driven member configured to be rotatably driven by the drive device, a spindle rotatably supported within a housing, an impact attenuation mechanism disposed between the driven member and the spindle and transmitting rotation of the driven member to the spindle while an impact applied to the driven member being attenuated, and a driven member support bearing rotatably supporting the driven member, so that the driven member can rotate relative to the spindle.

DETAILED DESCRIPTION OF THE INVENTION

Figure 1:
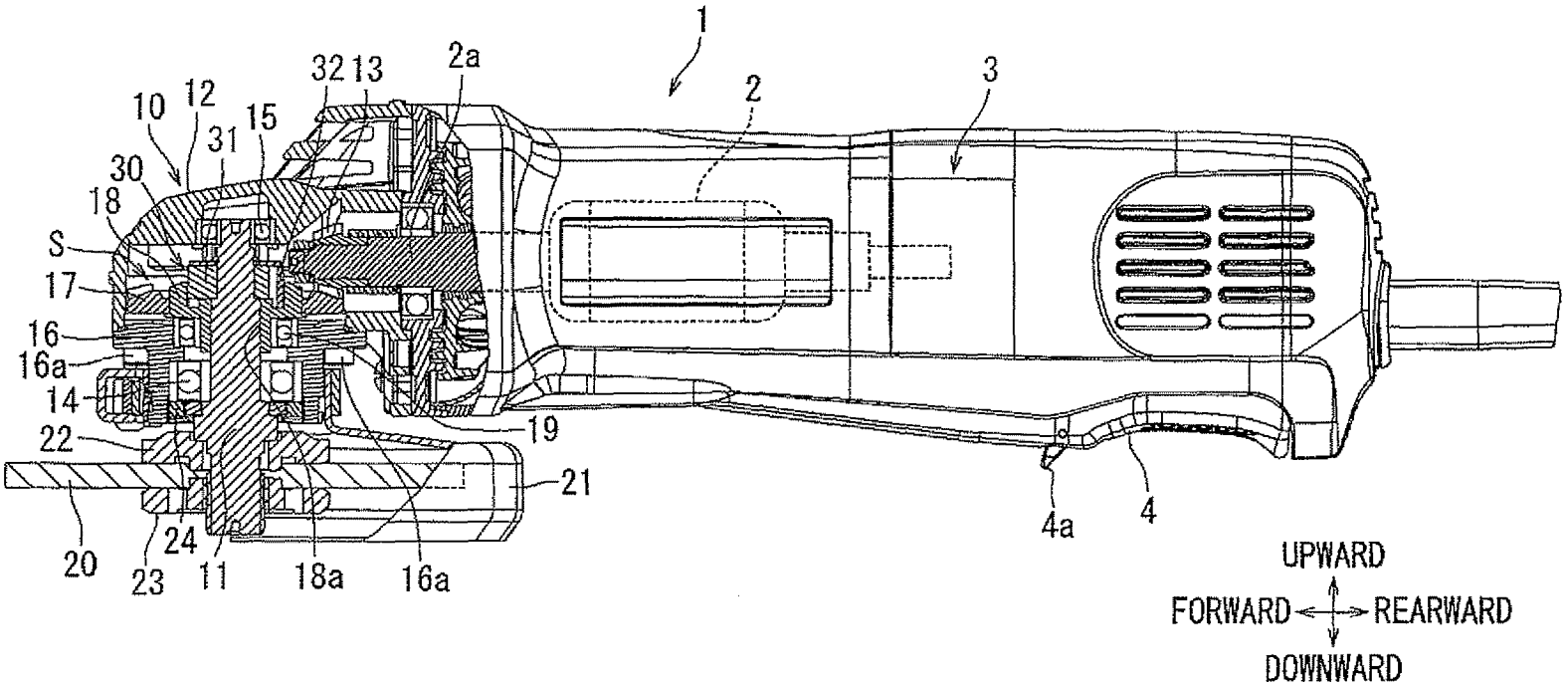
FIG. 1 is a side view of a rotary tool according to a representative example, with a part broken away for showing a gear head device in a vertical sectional view.

Each of the additional features and teachings disclosed above and below may be utilized separately or in conjunction with other features and teachings to provide improved rotary tools. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful examples of the present teachings. Various examples will now be described with reference to the drawings.

In one example, a rotary tool includes an electric motor, a gear head housing, and a reduction gear train disposed within the gear head housing and including a drive gear and a driven gear meshing with each other. The drive gear is coupled to the electric motor. The rotary tool further includes a spindle rotatably supported within the gear head housing via a first bearing and a second bearing, and an impact attenuation mechanism disposed between the driven gear and the spindle and transmitting rotation of the driven gear to the spindle while an impact applied to the driven gear being attenuated. The impact attenuation mechanism includes a torque transmission member interposed between the driven gear and the spindle. The torque transmission member is resiliently deformable when transmitting rotation of the driven gear to the spindle. A third bearing is disposed between the gear housing and the driven gear, so that the driven gear is rotatably supported by the gear housing.

Therefore, the driven gear is rotatably supported by the gear housing that rotatably supports the spindle. With this arrangement, in the case that the driven gear has a support hole, into which the spindle is inserted, it is possible to reduce the pressure applied from the inner circumferential surface of the support hole to the outer circumferential surface of the spindle and to eventually reduce wear of these circumferential surfaces. As a result, it is possible to improve the durability of the electric motor. Further, due to the impact attenuation mechanism disposed between the spindle and the driven gear that is rotatably supported via the third bearing, it is possible to attenuate an impact or a shock that may be produced when the drive gear and the driven gear of the reduction gear train are brought to mesh with each other as the electric motor is started. Therefore, the rotary tool is improved also in this respect.

The driven gear may include a support boss portion having a support hole formed therein, and the spindle is inserted into the support hole, so that the inner circumferential surface of the support hole slidably contacts the outer circumferential surface of the spindle. The housing may include a bearing holder. One of the first and second spindle support bearings is mounted to the bearing holder. The third bearing is interposed between the support boss portion and the bearing holder. With this arrangement, it is possible to reduce the surface pressure that may be applied from the inner circumferential surface of the support hole to the outer circumferential surface of the spindle, resulting in reduction of potential wear of these surfaces. As a result, it is possible to reduce potential vibration of the driven gear and eventually to improve the durability of the electric motor.

A groove or grooves may be formed in at least one of the outer circumferential surface of the spindle and an inner circumferential surface of the support hole at least within a region where the inner circumferential surface of the support hole slidably contacts the outer circumferential surface of the spindle. Therefore, in the event that wear powder has been produced as a result of fretting wear of these circumferential surfaces, the produced wear powder may enter the groove not to cause further wear of the surfaces. In addition, it is possible to prevent fixation between the driven gear and the spindle by the wear powder (i.e., adhesion due to baking of the wear powder).

A representative example will now be described with reference to FIGS. 1 to 3. Referring to FIG. 1, there is shown a rotary tool 1 configured as a disk grinder as an example.

The rotary tool 1 generally includes a tool body 3, an electric motor 2 disposed within the tool body 3, and a gear head device 10 coupled to the front portion of the tool body 3. The tool body 3 has a cylindrical configuration having an outer diameter suitable to be grasped by a hand of a user. A switch lever 4 having a relatively large size is mounted to the bottom of the rear portion of the tool body 3 and can be pushed by a hand of a user who grasps the tool body 3. The electric motor 2 is started when the switch lever 4 is pushed upward from an OFF position shown in FIG. 1 to an ON position (not shown). When the user releases the pushing operation, the switch lever 4 returns to the OFF position, so that the motor 2 is stopped. A lock lever 4*a* is associated with the switch lever 4 and is operable to hold the switch lever 4 selectively at the ON position or the OFF position.

The gear head device 10 is configured to transmit the rotation of the electric motor 2 to a spindle 11 via a reduction gear train that can reduce the rotational speed of the electric motor 2. In this example, a gear head assembly S including an impact attenuation mechanism 30 is assembled within the gear head device 10. The gear head device 10 includes a gear head housing 12. The gear head housing 12 has a downwardly oriented opening and is mounted to the front portion of the tool body 3. An output shaft 2*a* of the electric motor 2 extends into the gear head housing 12. A drive gear 13 is mounted on the output shaft 2*a* and meshes with a driven gear 17 of the gear head assembly S. In this example, bevel gears are used for both of the drive gear 13 and the driven gear 17. The drive gear 13 and the driven gear 17 constitute the reduction gear train that reduces the rotation of the electric motor 2 before transmission to the spindle 11. The details of the gear head assembly S are shown in FIGS. 2 and 3.

Figure 2:
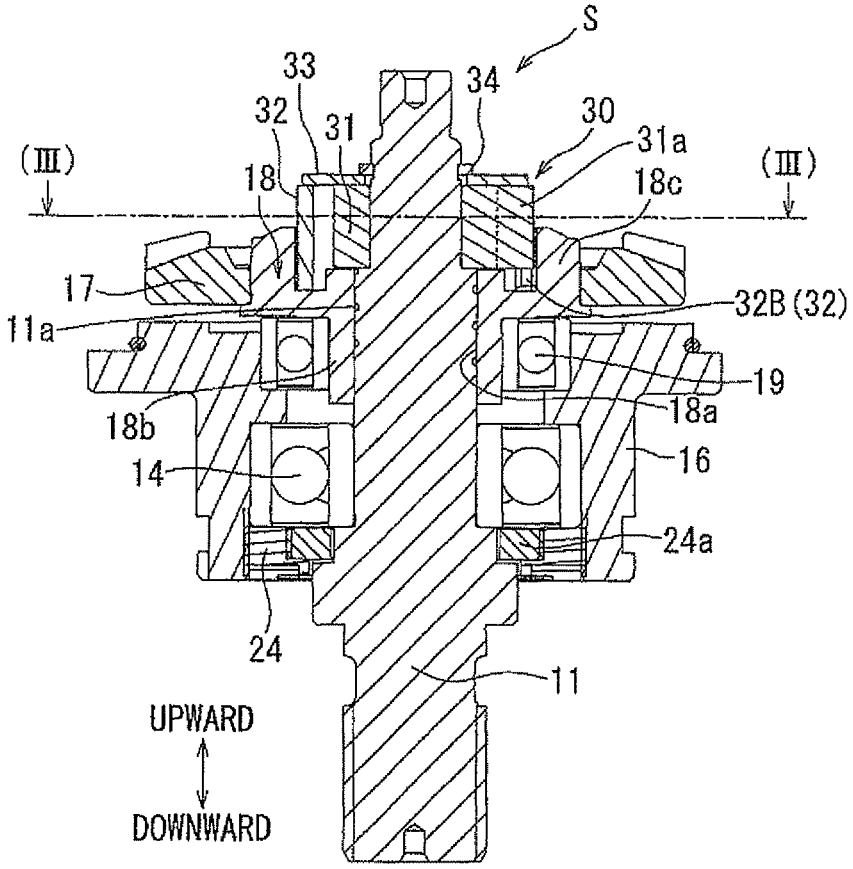
FIG. 2 is an enlarged vertical sectional view of a gear head assembly shown in FIG. 1.

The gear head assembly S is constituted by a bearing holder 16, the driven gear 17 and the impact attenuation mechanism 30 that are assembled to the spindle 11 in this order from the lower side as viewed in FIG. 2 though the lower opening of the gear head housing 12. As shown in FIG. 1, the bearing holder 16 is fixed to the lower surface of the gear head housing 12 by using four screws 16*a* (see FIG. 3).

The spindle 11 is rotatably supported by a first spindle support bearing 14 mounted within the bearing holder 16 and a second spindle support bearing 15 mounted within the upper portion of the gear head housing 12. The first spindle support bearing 14 and the second spindle support bearing 15 will be hereinafter simply called the "first bearing 14" and the "second bearing 15", respectively. The rotational axis of the spindle 11 extends substantially perpendicular to the rotational axis of the output shaft 2*a* of the electric motor 2. In this example, ball bearings are used for the first and second bearings 14 and 15.

A retainer 24 is fitted into the inner circumference of the lower portion of the bearing holder 16 at a position below the first bearing 14. The retainer 24 serves to fix the first bearing 14 in position relative to the bearing holder 16 with respect to the axial direction. An annular felt material 24 is fitted into the inner circumference of the retainer 24 and serves as a dust-preventing member for preventing dust from entering the first bearing 14.

The spindle 11 protrudes downward beyond the lower end of the bearing holder 16. A circular grinding wheel 20 and a wheel cover 21 for covering mainly a substantially rear half of the circumference of the grinding wheel 20 are mounted to the protruded lower end portion of the spindle 11. The grinding wheel 20 is clamped between a receptive flange 22 mounted to the lower end portion of the spindle 11 and a fixing nut 23 threadably engaging the spindle 11, so that the grinding wheel 20 is fixedly mounted to the spindle 11.

The driven gear 17 is supported so as to be rotatable relative to the spindle 11. More specifically, a gear holder 18 is fixedly mounted within the driven gear 17 and serves as a part of the driven gear 17. The gear holder 18 has a support hole 18*a*, into which the spindle 11 is slidably inserted. The lower portion of the gear holder 18 is formed with a support boss portion 18*b* (see FIG. 2) that extends into the inner circumference of the bearing holder 16 and is rotatably supported within the bearing holder 16 via a driven gear support bearing 19 that will be hereinafter called a "third bearing 19." Similar to the first and second bearings 14 and 15, a ball bearing is used for the third bearing 19. In this example, a clearance between the inner circumferential surface of the support hole 18*a* and the outer circumferential surface of the spindle 11 (hereinafter simply called a clearance between the support hole 18*a* and the spindle 11) is set to be between about 0.004 mm and about 0.050 similar to the known art. Therefore, the drive gear 17 (and the gear holder 18) can be easily assembled with the spindle 11 so as to be prevented from displacement (offset) of the central axis of the drive gear 17 from the central axis of the spindle 11 (hereinafter simply called offset with respect to the center).

Because the driven gear 17 is not directly supported by the spindle 11 but is supported by the bearing holder 16 via the third bearing 19, it is possible to prevent offset with respect to the center of the driven gear 17. Therefore, a pressure that may be applied from the inner circumferential surface of the support hole 18*a* of the gear holder 18 to the outer circumferential surface of the spindle 11 by during transmission of torque can be reduced, so that potential wear of these surfaces can be reduced.

A receptive boss portion 18*c* having a diameter larger than the support boss portion 18*b* is formed with the upper portion of the gear holder 18. The receptive boss portion 18*c* is coaxial with the support boss portion 18*b*. In this example, the driven gear 17 is integrated with the gear holder 18 by press-fitting the driven gear 17 onto the outer circumference of the receptive boss portion 18*c*.

The impact attenuation mechanism 30 is assembled within the inner circumference of the receptive boss portion 18*c*, so that the rotation of the driven gear 17 is transmitted to the spindle 11 via the impact attenuation mechanism 30. More specifically, a joint sleeve 31 is press-fitted onto the spindle 11 so as to be integrated with the spindle 11 at a position on the inner circumferential side of the receptive boss portion 18*c*. A driven-side projection 31*a* protrudes radially outward from the joint sleeve 31. To correspond to the driven-side projection 31*a*, a drive-side projection 18*d* protrudes radially inward from the inner circumference of the receptive boss portion 18*c* so as to be opposed to the driven-side projection 31*a* in the circumferential direction.

A C-shaped torque transmission member 32 is interposed between the outer circumference of the joint sleeve 31 and the inner circumference of the receptive boss portion 18*c*. The drive-side projection 18*d* and the driven-side projection 31*a* are positioned between first and second ends 32*a* and 32*b* opposite to each other in the circumferential direction of the torque transmission member 32. As shown in FIG. 2, the torque transmission member 32 is prevented from moving in the axial direction relative to the spindle 11 by a stopper flange 33 that is prevented from moving in the axial direction by a stopper ring 34 mounted to the spindle 11.

Figure 3:
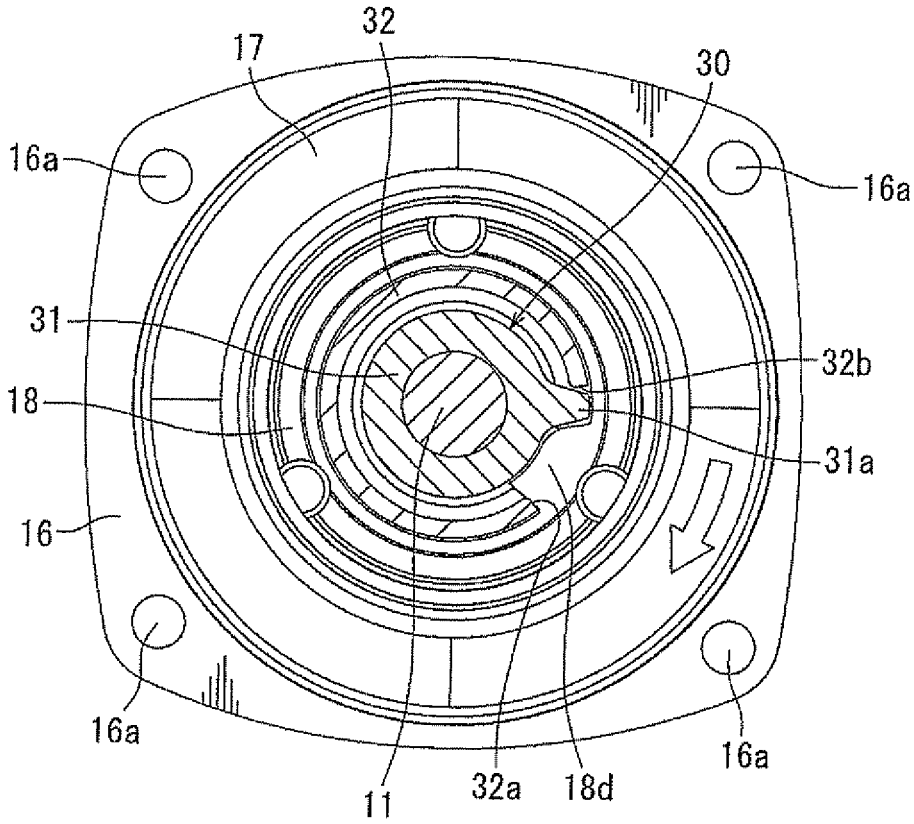
FIG. 3 is a sectional view of the gear head assembly taken along line III-III in FIG. 2.

As the rotational torque is transmitted to the driven gear 17 in a direction indicated by an outline arrow in FIG. 3 through meshing with the drive gear 13, the drive-side projection 18*d* integrated with the driven-side gear 17 moves in the same direction to push the first end 32*a* of the torque transmission member 32, so that the torque transmission member 32 is forced to move in the direction indicated by the outline arrow in FIG. 3. Then, the second end 32*b* of the torque transmission member 32 abuts to the driven-side projection 31*a* on the side of the spindle 11. As the first end 32*a* is pushed by the driven-side projection 18*d* on the side of the driven gear 17 and the second end 32*b* is forced to abut to the drive-side projection 31*a*, the torque transmission member 32 resiliently deforms in a direction of increasing its diameter so as to be pressed against the inner circumferential surface of the receptive boss portion 18*c*. Therefore, the spindle 11 rotates with the driven gear 17.

As the driven gear 17 and the spindle 11 are integrated with each other with respect to rotation by the impact attenuation mechanism 30 as described above, the rotational torque in the direction indicated by the outline arrow in FIG. 3 is transmitted to the spindle 11 via the driven gear 17, so that a large transmission torque can be applied to the grinding wheel 20. In addition, because the torque transmission member 32 resiliently deforms in the diameter increasing direction, it is possible to absorb or attenuate an impact or a shock that may be produced when the drive gear 13 and the driven gear 17 are brought to mesh with each other.

Further, in this representative example, a groove 11*a* is formed in the outer circumferential surface of the spindle 11 within a region where the inner circumferential surface of the support hole 18*a* of the gear holder 19 slidably contacts the outer circumferential of the spindle 11, so that it is possible to cope with potential fretting wear of these circumferential surfaces. In this example, the groove 11*a* has a spiral shape around the axis of the spindle 11.

As described above, according to the representative example described above, the driven gear 17 is rotatably supported by the bearing holder 16 via the third bearing 19, so that the driven gear 17 can rotate relative to the spindle 11. Therefore, it is possible to reduce the pressure that may be applied from the inner circumferential surface of the support hole 18*a* of the gear holder 18 (serving as a part of the driven gear 17) to the spindle 11 inserted into the support hole 18*a*. Therefore, wear of the inner circumferential surface of the support hole 18*a* and wear of the outer circumferential surface of the spindle 11 can be reduced. In other words, wear of both of the driven gear 17 and the spindle 11 can be reduced. As a result, it is possible to reduce vibrations of the driven gear 17, which may be produced due to transmission of torque. Eventually, it is possible to improve the durability of the electric motor 2.

In addition, the impact attenuating mechanism 30 is interposed between the driven gear 17 (more specifically, the gear holder 18) and the spindle 11 for attenuating a start shock that may be produced by the meshing of the reduction gear mechanism when the electric motor 2 is started. Therefore, the durability of the electric motor 2 can be improved also in this respect. In the representative example, the spindle 11 can rotate relative to the gear holder 18 (or the driven gear 17) for the convenience of providing the impact attenuation mechanism 30, and the third bearing 19 is interposed between the driven gear 17 (or the gear holder 18) and the bearing holder 16 (that rotatably supports the spindle 11) to resolve the problem of friction that may be produced between them.

Furthermore, according to the representative example, the groove 11*a* is formed in the outer circumferential surface of the spindle 11 within a region where the inner circumferential surface of the support hole 18*a* of the gear holder 18 slidably contacts (or is radially opposed to) the outer circumferential of the spindle 11 for coping with potential fretting wear of the spindle 11. Thus, even in the event that fretting wear has occurred at the inner circumferential surface of the support hole 18*a* and/or the outer circumferential surface of the spindle 11, wear powder produced at these surfaces may enter the groove 11*a*. Therefore, the wear powder may not cause further wear of the surfaces. In addition, it is possible to prevent fixation between the gear holder 18 and the spindle 11 by the wear powder (i.e., adhesion due to baking of the wear powder).

The above representative example may be modified in various ways. For example, in the above example, the third bearing 19 is interposed between the outer circumference of the support boss portion 18*b* and the inner circumference of the bearing holder 16 in order to indirectly rotatably support the driven gear 17 relative to the spindle 11. However, the third bearing 19 may be interposed between the inner circumference of the support boss portion 18*b* and the outer circumferential surface of the spindle 11 in order to rotatably support the driven gear 17 directly on the spindle 11.

In addition, although a ball bearing is used for the third bearing 19 in the above example, a needle bearing, a tapered roller bearing, any other roller bearing or a slide bearing can be used for the third bearing 19. Further, although the gear holder 18 is a separate member from the driven gear 17 and is integrated with the driven gear 17, the gear holder 18 and the driven gear 17 may be formed into one piece, which does not require integration after manufacturing these elements.

Furthermore, although the groove 11*a* formed in the outer circumferential surface of the spindle 11 for coping with fretting wear has a spiral shape, the groove 11*a* may be replaced with a plurality of parallel annular grooves spaced from each other in the axial direction. Alternatively, the spiral groove or the plurality of parallel annular grooves may be formed in the inner circumferential surface of the support hole 18*a*.

Furthermore, although the rotary tool 1 was exemplified to be a disk grinder, the present invention may be applied to any other rotary tools, such as a disk sander, a polisher and cutting devices including a miter saw, a brush cutter and a portable band saw. Such rotary tools may not be limited to those driven by electric motors but may be pneumatically driven or may be driven by engines.

What is claimed is:

1. A rotary tool comprising:

a drive device;

a driven member configured to be rotatably driven by the drive device;

a spindle rotatably supported within a housing;

an impact attenuation mechanism disposed between the driven member and the spindle and transmitting rotation of the driven member to the spindle while an impact applied to the driven member being attenuated; and a driven member support bearing rotatably supporting the driven member, so that the driven member can rotate relative to the spindle, wherein the spindle is rotatably supported by a first spindle support bearing and a second spindle support bearing mounted within the housing, and the driven member support bearing is disposed between the first spindle support bearing and the second spindle support bearing in an axial direction of the spindle.

2. The rotary tool as in claim 1, further comprising:

a reduction gear train disposed within the housing and including a drive gear and a driven gear meshing with each other, the drive gear being coupled to the drive device, wherein the driven member comprises the driven gear.

3. The rotary tool as in claim 1, wherein the impact attenuation mechanism includes a torque transmission member interposed between the driven member and the spindle, and the torque transmission member is resiliently deformable when transmitting rotation of the driven member to the spindle.

4. The rotary tool as in claim 1, wherein:

the driven member includes a support boss portion having a support hole formed therein; and the spindle is inserted into the support hole, so that the inner circumferential surface of the support hole slidably contacts the outer circumferential surface of the spindle.

5. The rotary tool as in claim 4, wherein;

the housing includes a bearing holder;

one of the first and second spindle support bearings is mounted to the bearing holder; and the driven member support bearing is interposed between the support boss portion and the bearing holder.

6. The rotary tool as in claim 4, wherein:

a groove is formed in at least one of the outer circumferential surface of the spindle and an inner circumferential surface of the support hole at least within a region where the inner circumferential surface of the support hole slidably contacts the outer circumferential surface of the spindle, so that powder produced due to wear of the outer circumferential surface of the spindle and the inner circumferential surface of the support hole can enter the groove.

7. The rotary tool as in claim 1, wherein an entirety of the impact attenuation mechanism is disposed over the driven member support bearing in an axial direction of the spindle.

8. A rotary tool comprising:

an electric motor;

a gear head housing:

a reduction gear train disposed within the gear head housing and including a drive gear and a driven gear meshing with each other, the drive gear being coupled to the electric motor, a spindle rotatably supported within the gear head housing via a first bearing and a second bearing;

an impact attenuation mechanism disposed between the driven gear and the spindle and transmitting rotation of the driven gear to the spindle while an impact applied to the driven gear being attenuated;

wherein the impact attenuation mechanism includes a torque transmission member interposed between the driven gear and the spindle, the torque transmission member being resiliently deformable when transmitting rotation of the driven gear to the spindle; and a third bearing rotatably supporting the driven gear, so that the driven gear can rotate relative to the spindle;

wherein the third bearing is disposed between the first bearing and the second bearing in an axial direction of the spindle.

9. The rotary tool as in claim 8, wherein the driven gear includes a support boss portion having a support hole formed therein, and the spindle is inserted into the support hole, so that the inner circumferential surface of the support hole slidably contacts the outer circumferential surface of the spindle.

10. The rotary tool as in claim 9, wherein:

the gear head housing includes a bearing holder;

one of the first and second spindle support bearings is mounted to the bearing holder; and the third bearing is interposed between the support boss portion and the bearing holder.

11. The rotary tool as in claim 9, wherein:

a groove is formed in at least one of the outer circumferential surface of the spindle and an inner circumferential surface of the support hole at least within a region where the inner circumferential surface of the support hole slidably contacts the outer circumferential surface of the spindle, so that powder produced due to wear of the outer circumferential surface of the spindle and the inner circumferential surface of the support hole can enter the groove.

12. The rotary tool as in claim 8, wherein an entirety of the impact attenuation mechanism is disposed over the third bearing in an axial direction of the spindle.

13. A rotary tool comprising:

a drive device;

a driven member configured to be rotatably driven by the drive device;

a spindle rotatably supported within a housing;

an impact attenuation mechanism disposed between the driven member and the spindle and transmitting rotation of the driven member to the spindle while an impact applied to the driven member being attenuated; and a driven member support bearing rotatably supporting the driven member, so that the driven member can rotate relative to the spindle, wherein:

the driven member includes a support boss portion having a support hole formed therein;

the spindle is inserted into the support hole, so that the inner circumferential surface of the support hole slidably contacts the outer circumferential surface of the spindle;

the housing includes a bearing holder;

one of the first and second spindle support bearings is mounted to the bearing holder; and the driven member support bearing is interposed between the support boss portion and the bearing holder.

14. A rotary tool comprising:

an electric motor;

a gear head housing:

a reduction gear train disposed within the gear head housing and including a drive gear and a driven gear meshing with each other, the drive gear being coupled to the electric motor, a spindle rotatably supported within the gear head housing via a first bearing and a second bearing;

an impact attenuation mechanism disposed between the driven gear and the spindle and transmitting rotation of the driven gear to the spindle while an impact applied to the driven gear being attenuated;

wherein the impact attenuation mechanism includes a torque transmission member interposed between the driven gear and the spindle, the torque transmission member being resiliently deformable when transmitting rotation of the driven gear to the spindle; and a third bearing rotatably supporting the driven gear, so that the driven gear can rotate relative to the spindle, wherein:

the driven gear includes a support boss portion having a support hole formed therein, and the spindle is inserted into the support hole, so that the inner circumferential surface of the support hole slidably contacts the outer circumferential surface of the spindle;

the gear head housing includes a bearing holder;

one of the first and second spindle support bearings is mounted to the bearing holder; and the third bearing is interposed between the support boss portion and the bearing holder.

* * * * *